US006657144B2

(12) United States Patent
Savicki, Jr. et al.

(10) Patent No.: US 6,657,144 B2
(45) Date of Patent: Dec. 2, 2003

(54) THROUGH STRAP FOR SWITCH

(75) Inventors: Gerald R. Savicki, Jr., Syracuse, NY (US); Mark S. DelFavero, Marcellus, NY (US)

(73) Assignee: Pass & Seymour, Inc., Syracuse, NY (US)

( * ) Notice: Subject to any disclaimer, the term of this patent is extended or adjusted under 35 U.S.C. 154(b) by 42 days.

(21) Appl. No.: 10/034,802

(22) Filed: Dec. 28, 2001

(65) Prior Publication Data

US 2003/0121765 A1 Jul. 3, 2003

(51) Int. Cl.[7] ..... H01H 9/00

(52) U.S. Cl. ..... 200/296; 200/293; 200/294; 174/53; 174/54

(58) Field of Search ..... 174/52.1, 53, 54, 174/58; 200/293–297, 303–307

(56) References Cited

U.S. PATENT DOCUMENTS 4,255,637 A 3/1981 Matsuda ..... 200/293
4,871,893 A * 10/1989 Slovak et al. ..... 200/16 R
4,880,950 A * 11/1989 Carson et al. ..... 200/547
5,213,204 A 5/1993 Sommer ..... 200/303
5,445,539 A * 8/1995 Dale ..... 439/535
5,783,787 A 7/1998 Data ..... 200/5 R
5,826,710 A * 10/1998 Kurek et al. ..... 200/559
5,990,436 A * 11/1999 Balaban et al. ..... 200/559
6,005,308 A 12/1999 Bryde et al. ..... 307/157
D430,497 S 9/2000 Michaels ..... D10/40
6,313,403 B1 * 11/2001 Livingston et al. ..... 174/54

* cited by examiner

*Primary Examiner*—Michael Friedhofer
(74) *Attorney, Agent, or Firm*—Wall Marjama & Bilinski LLP

(57) ABSTRACT

A switch which includes an internal metal strap which is captivated by a top enclosure and a bottom enclosure with the top enclosure being configured to captivate the strap and provide an attachment point for a switch actuator. The bottom enclosure also functions to captivate the strap and provide an enclosure for electrical terminals. The strap has a substantially planar configuration and contains at least one member which functions to position and orient said strap in a predetermined location with respect to both the top and bottom enclosures.

5 Claims, 5 Drawing Sheets

THROUGH STRAP FOR SWITCH

BACKGROUND OF THE INVENTION

The present invention relates in general to electrical switches and more specifically to a switch which includes an internal through-strap which does not require a separate component which acts as a barrier to isolate the strap from the switch terminals.

The following patents illustrate a variety of electrical switching devices which exemplify the state of the art with respect to through-straps or equivalent components.

U.S. Pat. No. 4,255,637 (Matsuda) discloses a switch assembly which includes a case 12 containing light control components, a front panel 16 furnished with a control knob, and a radiating plate 14 (a through-strap) for attaching the assembly to a switch box 21 and mounted between the case and the front panel. The assembly requires an insulating plate 50.

U.S. Pat. No. 5,213,204 (Sommer) discloses an electrical switch assembly including a cover 30 for mounting a rocker switch 16 and a base 28 for mounting a switch unit 14. No strap is disclosed, but the cover 30, which is external, also performs many of the functions of a through-strap.

U.S. Pat. No. 5,783,787 (Data) discloses a switch assembly including a front housing 12 in which four rocker actuators 30 are mounted, and a rear wiring module 42 in which terminals 44 are mounted. A front plate 40, which is similar to an external through-strap, is mounted between the housing and the module.

U.S. Pat. No. 6,005,308 (Bryde et al.) discloses a switch and dimmer device that is interposed between a bezel housing 17 and a back cover 12. Yoke 20 is an external through-strap U.S. Pat. No. Des. 430,497 (Michaels) discloses an external yoke sandwiched between a cover member mounting a switch and a body member mounting the switch terminals.

The only internal through strap in the above cited prior art requires an insulating component to isolate the strap from the terminal. Where the through-strap is external, it does not provide for any significant reinforcement of the device

SUMMARY OF THE INVENTION

It is therefore an object of the present invention to provide an internal through-strap for an electrical device which overcomes the shortcomings of the prior art described above.

It is another object of the present invention to provide an internal through-strap for an electrical device which eliminates the need for a separate electrical barrier component.

It is a further object of the present invention to provide an internal through-strap which contributes to a rugged switch assembly by providing reinforcement for the device.

The present invention is directed to an electrical switch assembly which includes an internal metal strap or through-strap which functions to provide attachment means to an electrical enclosure. A top enclosure functions to captivate and holds a planar through-strap in a fixed, nesting engagement by contact between the bottom surface of the top enclosure and the top surface of the through strap. A body or bottom enclosure captivates and holds the through-strap in a fixed, nesting engagement by contact between the top surface the body and the bottom surface of the through-strap. The strap includes a vertically disposed tab which is designed and positioned to be received in a notch or well contained in the top enclosure which functions to orient and captivate the through-strap in a predetermined location during and after assembly. A corresponding notch is also included in the body which also functions to orient and captivate the through strap.

BRIEF DESCRIPTION OF THE DRAWINGS

For a further understanding of these and objects of the invention, reference will be made to the following detailed description of the invention which is to be read in connection with the accompanying drawings, wherein.

DETAILED DESCRIPTION OF THE INVENTION

Figure 1:
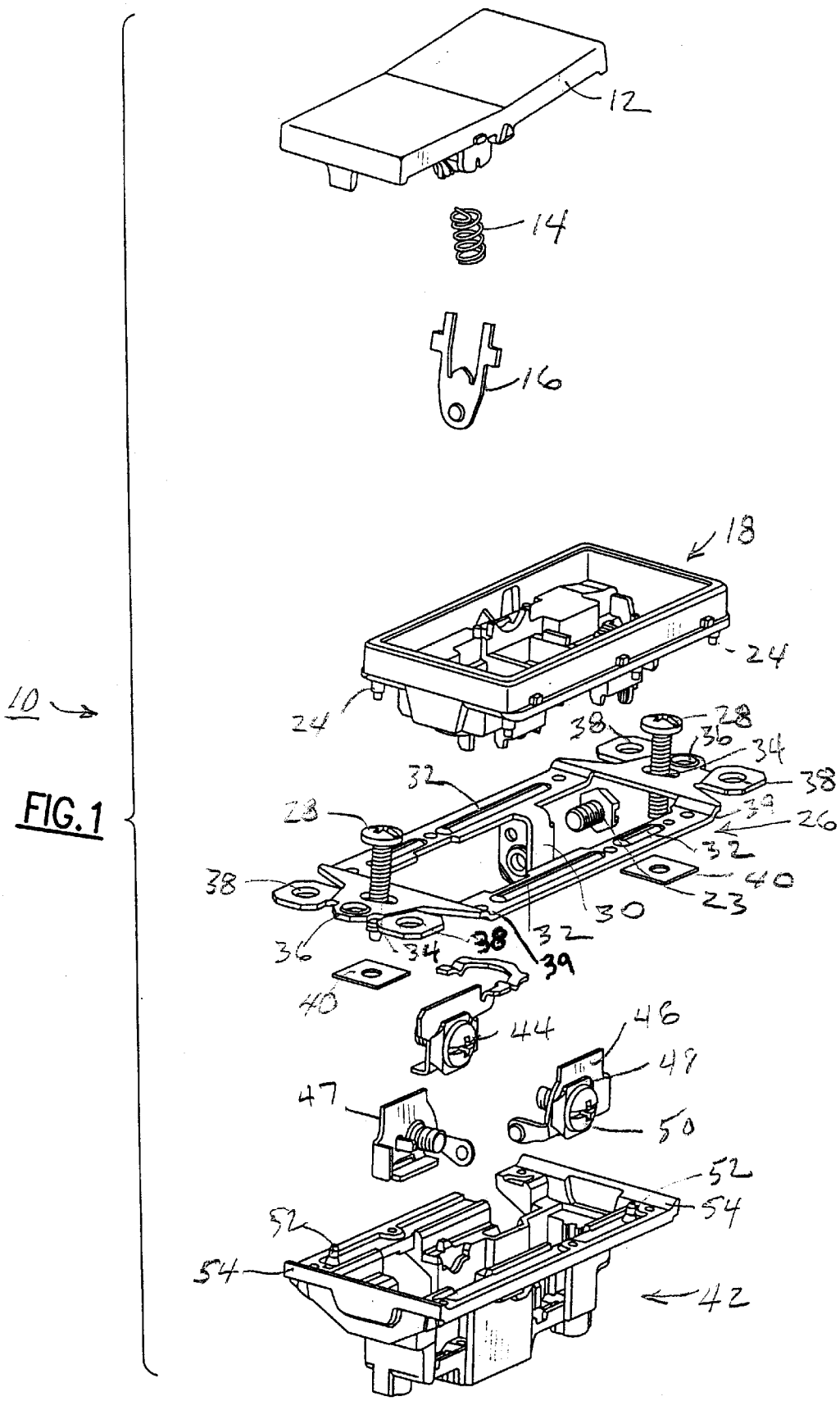
FIG. 1 is an exploded view of a switch assembly which incorporates the internal through strap of the present invention.

The invention is more completely understood with reference to FIG. 1 of the drawings which is an exploded view of the switch assembly 10 of the present invention. The invention includes a paddle or rocker 12, and associated spring 14 and moveable terminal 16. The paddle rocker and associated parts are connected to frame 18 along with the through strap 26 of the present invention. Through strap 26 contains mounting screws 28, ground screw 23 and ground tab 30. The strap further contains a mounting flange at either end which contains holes 34 to receive mounting screws 28 for fastening the assembly to a wall plate. Holes 36 are located at each end for receiving mounting screws for mounting the assembly to a wall box. Holes 38 are optionally used for fastening the assembly to a wallboard and can be easily broken away if not required for use. The assembly further contains a pivot terminal 44, stationary terminals 46 and 47, both terminals having a trip plate 48 and wire binding screw 50 which form a part of body 42.

Figure 2:
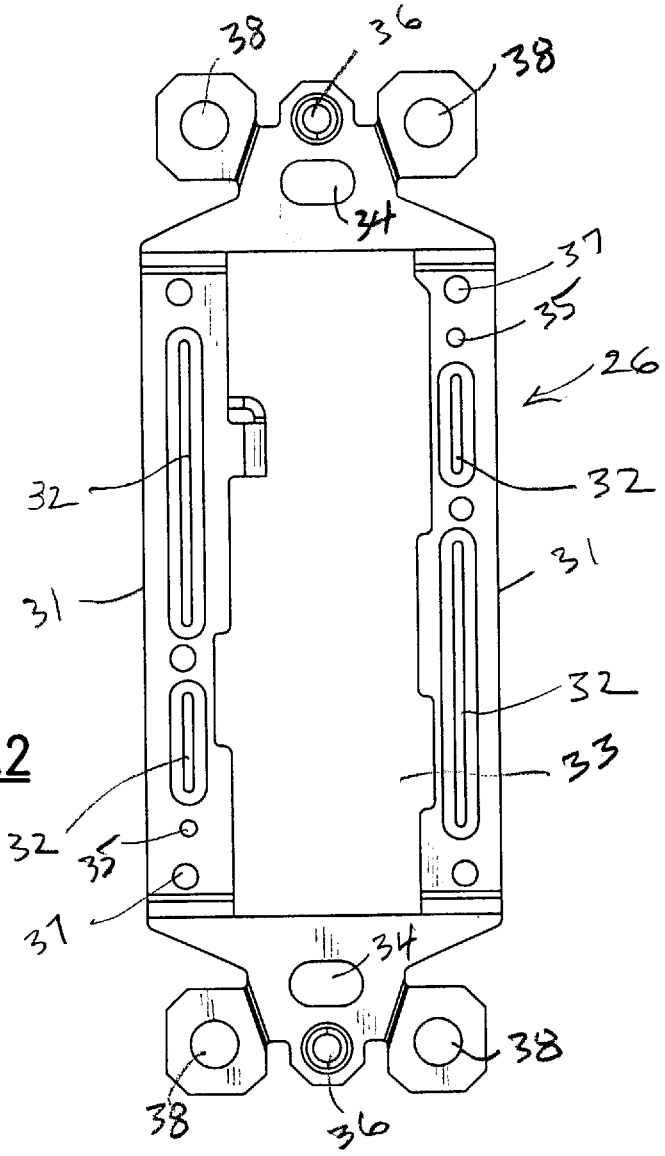
FIG. 2 is a front view of the through-strap of the present invention.
Figure 6:
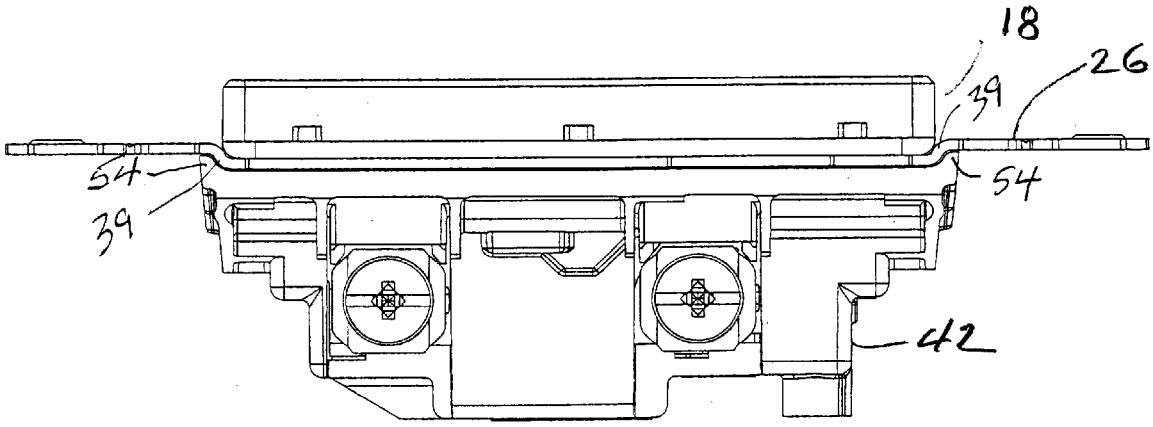
FIG. 6 is a side view of the assembled switch assembly.

FIG. 2 is a front view of the through strap of the present invention. The through strap 26 is basically rectangular in configuration having an open central portion 33 formed by a pair of elongated side members 31 which contain reinforcing ribs 32 and holes 37 which accommodate plastic tabs 24 contained on the frame which are used in heat sealing the device together in final assembly. Two holes 35 are also positioned to accommodate corresponding plastic sealing tabs 52 contained on body 42. As will be described in greater detail later, the reenforcing ribs 32 have a protruding or dimpled side as shown in FIG. 2, and a corresponding recessed back side. The protruding ribs allow for placement and nesting within corresponding recesses 20 (FIG. 4) contained in the edges of frame 18. The strap further contains a slight recess or bend near each end which forms a shoulder 39 to facilitate placement in body 42. Shoulders 39 aid in orienting and captivating the through strap with the vertical shoulder 54 formed at each end of body 42 (FIG. 6).

Figure 3:
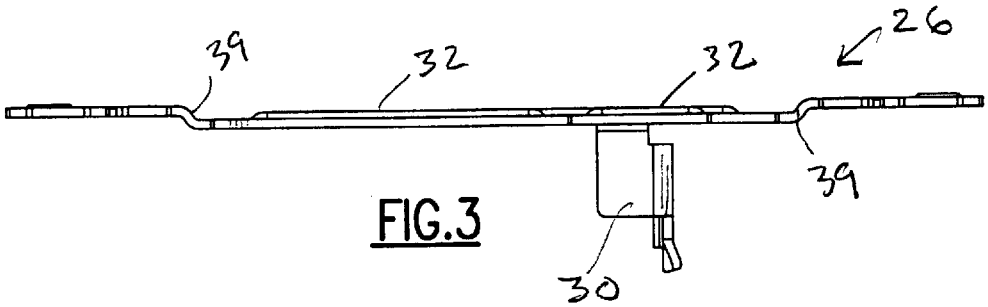
FIG. 3 is a side view of the through-strap of the present invention.

FIG. 3 is the side view of the through strap of the present invention which shows vertically attached ground tab 30, reinforcement ribs 32, and shoulders 39. The flat planar configuration of the through strap is designed to nest in fixed engagement and form a tight seal between the top frame 18 and bottom body portion 42.

Figure 4:
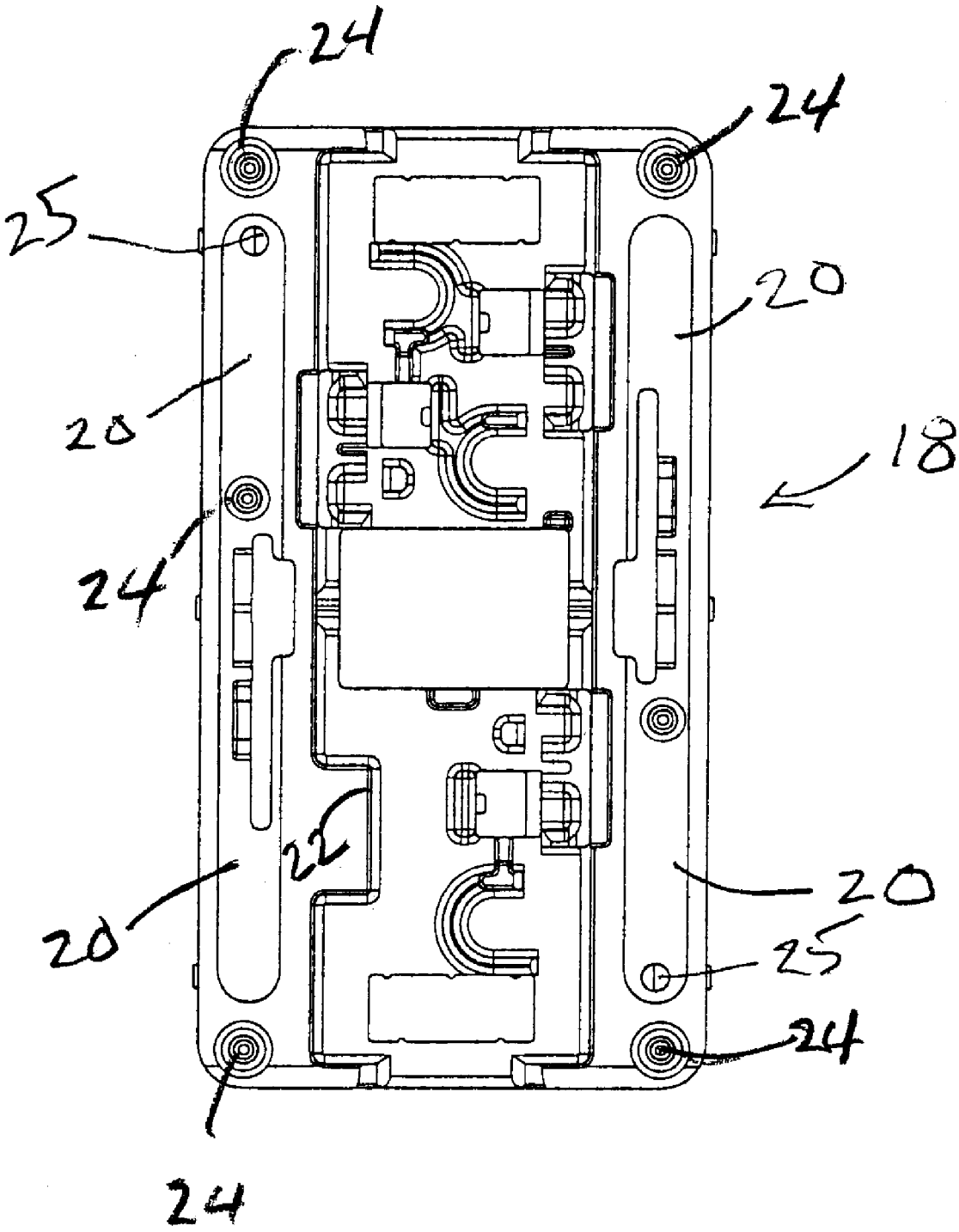
FIG. 4 is a back view of the frame or top enclosure of the switch assembly.

FIG. 4 is a back view of the frame or top enclosure which shows recesses 20 which accommodate the raised portions of the reinforcing ribs 32 of the through strap when the components are assembled. The frame further contains a plurality of vertical disposed plastic tabs 24 which pass through holes in the sides of the through strap and when heated, bond with holes in the body or bottom enclosure 42 to seal the assembly together. Notch 22 is designed to index and hold the through strap in place by contact with ground tab 30.

Figure 5:
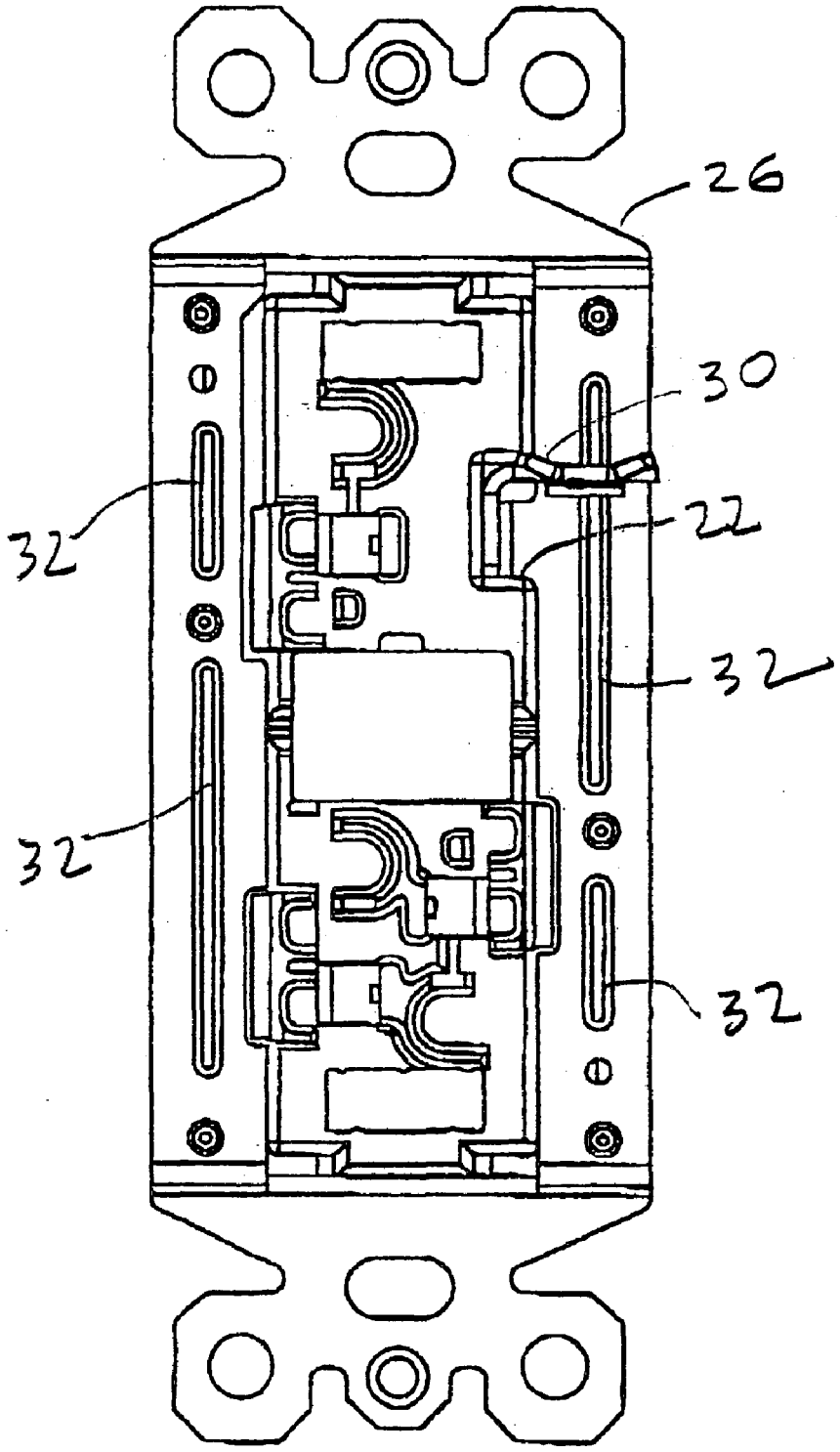
FIG. 5 is partial front view of the assembly with the frame and ground strap in assembled position.

FIG. 5 illustrates the through strap in assembled or nesting position against the underside of frame 18 with the ground tab 30 of the through strap contained in notch 22 of the frame. Notch 22 is formed at a predetermined location to allow for placement and indexing of the base of the ground tab to hold it in place and to ensure an accurate assembly of the two parts. In this view the protruding ribs 32 of the through strap are nesting in recesses 20 of frame 18.

FIG. 6 shows the switch assembly in its final assembled form in which the frame 18 and body 42 form a tight seal along the side edges of the through strap with the through strap providing for physical reinforcement of the switch assembly and where the frame through its recesses 20 allows the reinforcing ribs 32 of the strap to nest in said recesses which functions to position and isolate the metal strap away from the switch components when the assembly is sealed. Correspondingly, the body or bottom portion 42 of the assembly also has recessed surfaces which similarly function to isolate and segregate the strap from the switch components as in the frame described above. The strap also has been sized such that its outer edges basically conform to the outside dimensions of the frame and body. For example, in a switch having a width of approximately 1.75 inches, the strap is configured such that its width will be no greater than 1/32 inch more than the overall switch width. This feature becomes important when switches are used in a multigang arrangement and the overall width of the gang arrangement is critical with respect to space.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A switch assembly which includes a substantially planar metal strap which functions to provide attachment means to an electrical enclosure, said assembly comprising:

(a) a top enclosure which captivates and holds said planar metal strap in a fixed, nesting arrangement by contact between a bottom surface of said top enclosure and a top surface of said strap;

(b) a bottom enclosure which captivates and holds said strap in a fixed, nesting arrangement by contact between a top surface of said bottom enclosure and a bottom surface of said strap; and (c) with said strap including a vertically disposed tab which is designed and positioned to be received in a pocket contained in said top enclosure to orient and position said strap in a predetermined location during assembly.

2. A switch which includes an internal metal strap which is captivated by a top enclosure and a bottom enclosure with said top enclosure configured to captivate said strap and provide an attachment point for a switch actuator with said bottom enclosure also functioning to captivate said strap and provide an enclosure for electrical terminals, with said strap having a substantially planar configuration and containing at least one vertical member which functions to position and orient said strap in a predetermined location with respect to said top and bottom enclosures.

3. A switch assembly which includes an internal metal strap which is captivated by a top enclosure and a bottom enclosure with said top enclosure configured to captivate said strap and provide an attachment point for a switch actuator with said bottom enclosure also functioning to captivate said strap and provide an enclosure for electrical terminals, with said strap having a substantially planar configuration and containing at least one means which functions to position and orient said strap in a predetermined location and in fixed engagement with respect to said top and bottom enclosures, said at least one means including a plurality of reinforcing ribs.

4. The switch assembly of claim 3 in which said reinforcing ribs include a raised section which nests in a corresponding recess in said top enclosure.

5. The switch assembly of claim 3 in which a width of said planar metal strap is substantially equal to a width of said switch assembly.

* * * * *